US011458059B2

(12) United States Patent
Bell et al.

(10) Patent No.: US 11,458,059 B2
(45) Date of Patent: Oct. 4, 2022

(54) CREMATION VESSEL AND DISPLAY

(71) Applicants: Anthony George Bell, Hilton Head Island, SC (US); Edward Aldridge Maddox, Linwood, NJ (US)

(72) Inventors: Anthony George Bell, Hilton Head Island, SC (US); Edward Aldridge Maddox, Linwood, NJ (US)

( * ) Notice: Subject to any disclaimer, the term of this patent is extended or adjusted under 35 U.S.C. 154(b) by 0 days.

(21) Appl. No.: 17/409,387

(22) Filed: Aug. 23, 2021

(65) Prior Publication Data

US 2021/0378901 A1 Dec. 9, 2021

Related U.S. Application Data

(63) Continuation-in-part of application No. 16/501,865, filed on Jun. 19, 2019, now abandoned.

(60) Provisional application No. 62/687,508, filed on Jun. 20, 2018.

(51) Int. Cl.
*A61G 17/08* (2006.01)

(52) U.S. Cl.
CPC ..... *A61G 17/08* (2013.01); *A61G 2203/20* (2013.01)

(58) Field of Classification Search
CPC .... A61G 17/08; A61G 2203/20; A47G 33/00; E04H 13/00; E04H 13/008
USPC ..... 27/1, 14; D99/5; 206/19, 457
See application file for complete search history.

(56) References Cited

U.S. PATENT DOCUMENTS 5,379,499 A * 1/1995 Jackson ..... A61G 17/08 27/35
5,704,103 A * 1/1998 Crowley ..... E04H 13/003 40/124.5
5,987,720 A * 11/1999 Yamamoto ..... A61G 17/0136 27/35
6,044,532 A * 4/2000 Bowling ..... A61G 17/08 108/150
6,340,978 B1 * 1/2002 Mindrum ..... G06Q 10/10 715/764
6,414,633 B1 * 7/2002 Delalat ..... G01S 13/825 342/442
6,414,663 B1 * 7/2002 Manross, Jr. ..... G09G 3/3611 52/103
6,584,658 B2 * 7/2003 Robinson ..... A61G 17/08 27/1
7,089,495 B2 * 8/2006 Barrows ..... E04H 13/003 369/69
7,174,611 B1 2/2007 Rose et al.
7,475,458 B1 1/2009 Gordon et al.
8,510,921 B2 * 8/2013 Florea ..... A61G 17/04 40/725
8,707,526 B2 4/2014 Cooke et al.
(Continued)

*Primary Examiner* — William L Miller
(74) *Attorney, Agent, or Firm* — Armstrong Teasdale LLP; Edward F. Behm, Jr.; Benjamin A. Ailes

(57) ABSTRACT

A web connected ornamental funerary apparatus is controlled over a data network comprised of (1) a microprocessor and network connectivity for device and remote sound, image projection, communication and actuation, (2) a cremains repository that serves as (a) an ornament platform, (b) apparatus base, and (c) housing for microelectronic elements, (3) a cap which serves to (a) isolate and protect the cremains, (b) house micro circuitry, and (c) secure a physical hyaloid ornament sculpture and/or project light or a holographic image above the cap, (4) a locking mechanism, and (5) an ornamental feature situated above the repository.

12 Claims, 14 Drawing Sheets

(56) References Cited

U.S. PATENT DOCUMENTS

| | | | | |
|---|---|---|---|---|
| 8,776,333 | B2 * | 7/2014 | Van Den Bogart | A61G 17/08 283/67 |
| 8,909,670 | B2 * | 12/2014 | Neal | G06F 16/9535 434/378 |
| 8,935,837 | B2 * | 1/2015 | Jairala, Jr. | A61G 17/08 40/725 |
| 8,959,731 | B2 | 2/2015 | Lynch | |
| 8,966,725 | B2 | 3/2015 | Langelier | |
| 9,198,819 | B2 | 12/2015 | Reynolds | |
| 9,233,045 | B2 * | 1/2016 | Lynch | A61G 17/08 |
| D759,338 | S | 6/2016 | Reynolds | |
| 9,465,812 | B1 * | 10/2016 | Robinson | G06F 16/9537 |
| 9,775,760 | B1 * | 10/2017 | Roy | A61G 17/08 |
| 10,030,406 | B2 * | 7/2018 | Montgomery | G06F 3/147 |
| 10,052,251 | B1 | 8/2018 | Lu | |
| D841,927 | S | 2/2019 | Jennings | |
| 10,245,203 | B1 | 4/2019 | Norris | |
| D860,578 | S | 9/2019 | Reynolds et al. | |
| D871,015 | S | 12/2019 | Fuss | |
| 10,512,579 | B1 | 12/2019 | Michaud | |
| 10,610,437 | B2 * | 4/2020 | Reynolds | A61G 17/08 |
| 2007/0084027 | A1 | 4/2007 | Walczak | |
| 2010/0011549 | A1 * | 1/2010 | Thompson | A61G 17/08 27/1 |
| 2010/0012606 | A1 * | 1/2010 | Bourgo | A61G 17/08 211/85.27 |
| 2010/0102685 | A1 * | 4/2010 | Ward | A47F 3/00 312/223.5 |
| 2010/0146752 | A1 * | 6/2010 | Dannenberg | A61G 17/04 700/94 |
| 2013/0185907 | A1 * | 7/2013 | Langelier | A61G 17/08 27/1 |
| 2014/0047683 | A1 * | 2/2014 | Cooke | A61G 17/08 27/1 |
| 2014/0182096 | A1 * | 7/2014 | Jairala, Jr. | A47G 1/0616 27/1 |
| 2016/0353188 | A1 * | 12/2016 | Epps | A61G 17/08 |
| 2021/0071439 | A1 | 3/2021 | Currie | |

* cited by examiner

CAP AERIAL VIEW

CREMATION VESSEL AND DISPLAY

CROSS-REFERENCE TO RELATED APPLICATIONS

This application is a continuation-in-part application of U.S. Non-Provisional Ser. No. 16/501,865, filed Jun. 19, 2019 and currently pending, which claims the benefit of U.S. Provisional 62/687,508, filed Jun. 20, 2018, now expired, both of which are hereby incorporated by reference as if submitted in their entireties.

FIELD OF THE INVENTION

The present invention relates to a cremation vessel, and, more particularly, a cremation vessel comprised of a multi-piece construction including a latch lock base and a design piece.

BACKGROUND

For too long we, as a society have viewed death as a morbid, depressing occasion, where we are afraid to deal with it and talk about it. Death should not be a depressing end, but a bright new beginning Cremation urns are typically used to hold the ashes of the deceased. This practice of cremating the dead and placing the ashes, or cremains, into an urn dates back as far as 7000 B.C. Several solutions exist for storing the ashes of the deceased after cremation of their remains. Unfortunately, current solutions fail to meet the needs of the market because the ashes may be stored away, hidden from view, or forgotten. Attempts to scatter ashes of a loved one may not always be a viable option due to legal restraints as to where cremains of a loved one may be scattered. Another solution seeks to store the remains of the loved one within a larger structure, such as a mausoleum, with other cremated individuals, but this solution also fails to meet market needs because the remains of the loved one are often stored out of sight.

Therefore, there currently exists a need in the market for an apparatus that is customizable to fit the needs and wants of a family and the wishes of a loved one.

BRIEF SUMMARY OF THE INVENTION

The present embodiments may relate to an apparatus having a multi-piece construction for storing cremains. Even further, the multi-piece construction may include a vessel including twist-lock mechanism for the secure storage of cremains. The vessel, or urn, may comprise of multiple parts, such as a base portion, a latch lock base, and a top cap. In some embodiments, the vessel may further include an attachment portion for securely holding a design element. Additionally, the multi-piece construction may include a key lock portion. The attachment portion may be fastened to, or a part of, the top cap. The design element may be customizable and comprised of glass, stone, rubber, or other like elements.

The present embodiments may relate to an apparatus used to keep a loved one in a secure vessel or urn. Furthermore, the present embodiments provide an apparatus for display, such as on a bookshelf or fireplace mantel, and not in storage. For example, the apparatus may be provided as an addition of art to a room the apparatus is placed. Even further, the present embodiments provide an apparatus that is portable, suitable for indoor or outdoor use, and flexible and adaptable in providing a customizable vessel for the storage and display of a loved one's cremains. In some embodiments, the vessel may be upgraded with different design elements. Additionally, or alternatively, different portions of the cremation vessel may be replaced in the event of breakage, vandalism, or simply due to normal wear and tear. Customization of the vessel provides for the upgrading of certain elements, such as the replacement of a unique design element with a new element or the replacement of plastic elements with rubber elements, for example.

The present embodiments may relate to a cremation vessel and display. The cremation vessel and display may have a key lock. Additionally, the cremation vessel and display may have an urn base. The cremation vessel and display may have a twist lock mechanism used to insert sculptures onto the vessel. The twist lock mechanism may be part of a blank, low-profile cap portion of the vessel, allowing for the addition of a customized sculpture or design element.

BRIEF DESCRIPTION OF THE DRAWINGS

This disclosure is illustrated by way of example and not by way of limitation in the accompanying figure(s). The figure(s) may, alone or in combination, illustrate one or more embodiments of the disclosure. Elements illustrated in the figure(s) are not necessarily drawn to scale. Reference labels may be repeated among the figures to indicate corresponding or analogous elements.

Figure 1:
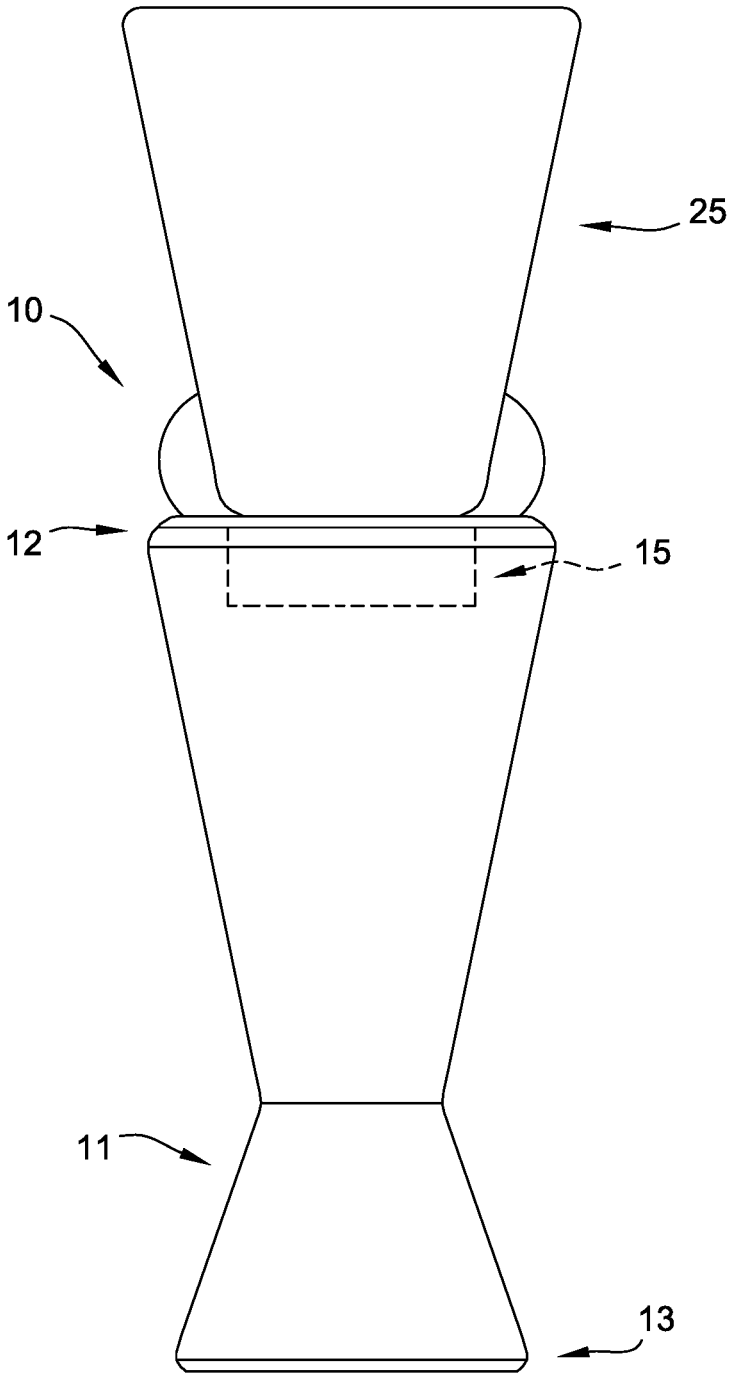
FIG. 1 illustrates the front of a cremation vessel and display in accordance with at least one embodiment.

The Figures depict preferred embodiments for purposes of illustration only. One skilled in the art will readily recognize from the following discussion that alternative embodiments of the systems and methods illustrated herein may be employed without departing from the principles of the invention described herein.

DETAILED DESCRIPTION

The figures and descriptions provided herein may have been simplified to illustrate aspects that are relevant for a clear understanding of the herein described apparatuses and methods, while eliminating, for the purpose of clarity, other aspects that may be found in typical similar apparatus and methods. Those of ordinary skill may thus recognize that other elements and/or operations may be desirable and/or necessary to create apparatuses and methods described herein. But because such elements and operations are known in the art, and because they do not facilitate a better understanding of the present disclosure, for the sake of brevity a discussion of such elements and operations may not be provided herein. However, the present disclosure is deemed to nevertheless include all such elements, variations, and modifications to the described aspects that would be known to those of ordinary skill in the art.

In some embodiments, a cremation vessel and display may be provided. The cremation vessel and display may include a processor and a memory device. The cremation vessel and display may be used to present death in a beautiful way. In some embodiments, the cremation vessel and display may be used to display a loved one, or deceased, as a work of art for people to see and experience. The cremation vessel and display may change the way death is perceived by not simply looking at the past and the end of what once was but bring out what could be. Additionally, the cremation vessel and display may memorialize and glorify a deceased person in a new, bright shining ray of light.

In some embodiments, a cremation vessel and display may be provided. The cremation vessel and display may include a processor and a memory device. The cremation vessel and display may be placed in different environments, such as inside a house or outside in an outdoor environment, for example. Additionally, the cremation vessel and display may be placed in a room, such as on a fireplace mantel, a bookcase, or on a table, for example. In some embodiments, may be placed in an open environment, such as in an outdoor environment or a high-visibility area. The cremation vessel and display may be viewed as a piece of art. For example, the cremation vessel and display may give a loved one new life as an art piece that is used to shine the loved one in all their glory.

In some embodiments, the cremation vessel and display may be created using a universal design. For example, the cremation vessel and display may be composed of a multi-piece construction, thereby allowing customization of the cremation vessel and display. In one embodiment, a reliquary vessel may be matched with a glass sculpture top piece that may be selected from many sculpture tops. The sculpture top is not limited to any certain materials. The sculpture top may comprise of glass, metal, stone, wood, or a combination thereof. The display is not limited to any certain design. Instead, a customized design may be used thereby permitting the creation of a unique and personalized cremation vessel and display. The cremation vessel may be connected to the display using a latch lock mechanism. For example, to enable the use of a custom display, the cremation vessel may include a latch lock mechanism having a latch lock base. The latch lock base may include a cap, such as a blank, low-profile cap. The blank, low-profile cap may be a removable cap, for example, that allows the display of the cremation vessel without a display portion. Prior to connecting a display portion to the cremation vessel via the latch lock mechanism, the blank, low-profile cap is removed.

In some embodiments, a cremation vessel and display may be provided. In some embodiments, the cremation vessel and display may comprise of a two-stage locking mechanism. The mechanism may be used to securely join an urn base, a latch lock base, and a top cap. In at least one embodiment, the top cap may be placed onto the latch base and twist locked onto the urn base. A seal may be created by the locking mechanism by using a specialized key. Additionally, the seal may create a waterproof seal. In some embodiments, a spring locking mechanism may be used.

A cremation vessel and display may be provided. The cremation vessel and display may include four interconnected elements: a base portion, a ceiling portion, an ornamental portion, and a locking mechanism. The four interconnected elements in the form of the base portion for the placement of ashes and secured with a locking mechanism, a ceiling portion, an ornamental feature, and secure locking mechanism to secure the entire structure with a key. The ceiling portion positioned above the base portion and configured with a cavity to store optional functional, decorative, or mechanical features, including but not limited to, ornaments, such as glass or crystal art, projectors to provide interior illumination, static and dynamic images or holographic displays, geolocation, and a locking mechanism for securing ornamental features. In some embodiments, a spring latch may be used for securing an ornamental portion to a ceiling portion of the vessel. A spring latch may be used to lock an ornamental element into place.

Referring to the figures, FIG. 1 to FIG. 11 show the cremation vessel and display according to the present disclosure. The device is generally adapted as a repository for the ashes of the deceased. The device including a base portion with a twist lock cap and key lock latch base to keep the device closed. The cap over the latch lock can be removed and replaced a custom design adapted to be inserted and secured. The design can by any ornamental feature or material, including, but not limited to, glass, or other similar material functioning as a sculpture top portion which is customized for the family and loved one.

Referring to FIGS. 1-11, a cremation funerary apparatus 10 is shown. The apparatus 10 may have a repository 11 that may be sized to receive the cremains of a deceased individual. Repository 11 may include an upper end 12 and a lower end 13. An access aperture 14 on the upper end is covered. A removable cap 15 may be configured to screw into the access aperture by one or more threads. The access aperture 14 may provide access to the interior of repository 11. As shown, cap 15 may include an upper panel 16, a lower panel 17, and a central aperture with a snap on flat lid 22. Further, cap 15 may include two descending proximal 24 and distal skirts 18 with a hollow interior housing three vertical latches 19 spaced 120 degrees and locking wards around the circumference within the circular confines of the opposing skirts.

Figure 8:
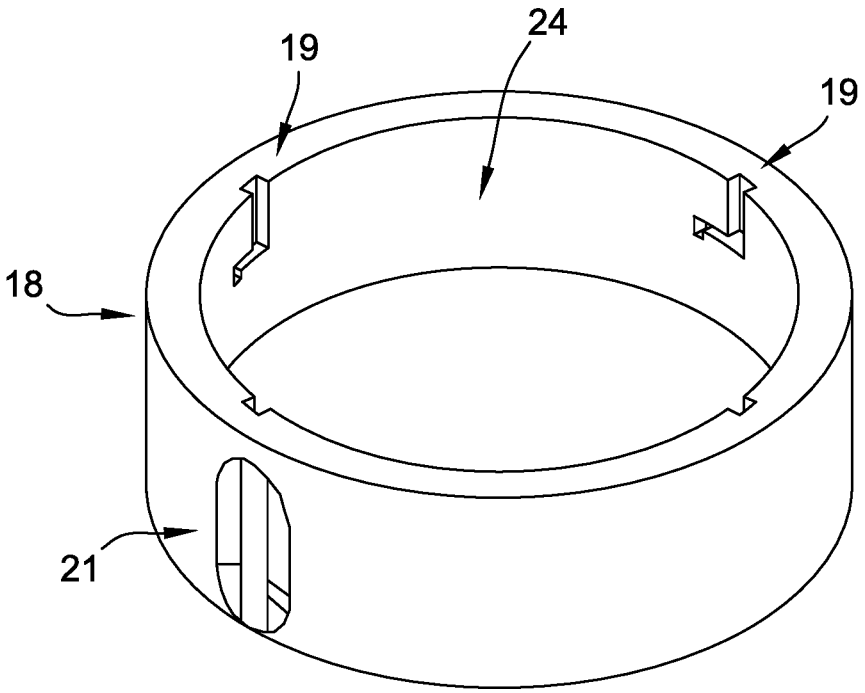
FIG. 8 illustrates a perspective view of the cremation vessel and display's lid.

As shown in FIG. 8, the interior of the cap aperture may extend 3-5 cm. The aperture may provide a docking port for an ornamental element 25, a docking element and microelectronic elements 21. As shown in FIG. 8, microelectronic elements 21 may be positioned on the distal external wall 18 of cap 15. Additionally, or alternatively, microelectronic elements may be positioned elsewhere, such as within a cavity, on an internal wall, on top, or on the bottom side of cap 15, for example. Microelectronic elements may include different types of small electronic designs and components. In some implementations, a combination of electronic elements and microelectronic elements may be used. Further, the electronic elements may include wireless network capabilities (e.g., WiFi, Bluetooth, NFC, etc.), data ports (e.g., USB, USB-C, MicroUSB, etc.), light elements (e.g., LED, projector, etc.), or the like.

Figure 9:
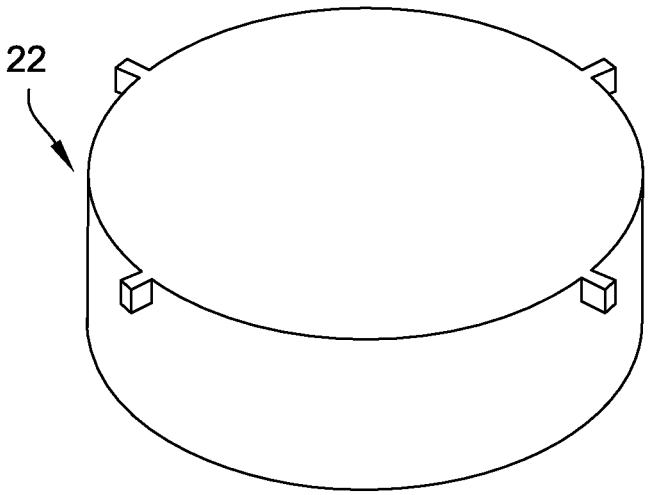
FIG. 9 illustrates a perspective view of the cremation vessel and display's lid with a cover.
Figure 10:
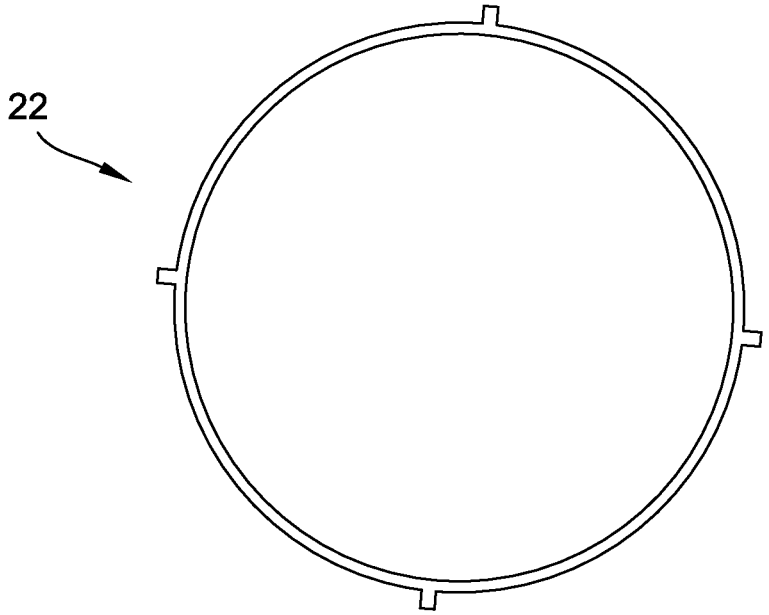
FIG. 10 illustrates the top of the lid.
Figure 11:
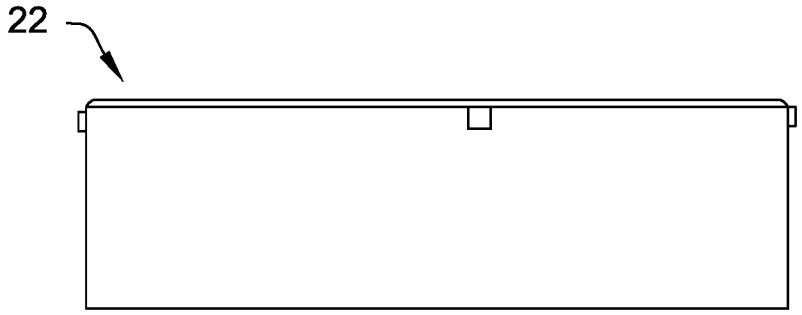
FIG. 11 illustrates the left side of the cremation vessel and display's lid.

As shown in FIG. 9, a flat lid 22 may snap into and cover a cap aperture when an ornamental feature 25 and/or microelectronic docking features 21 are not engaged. In at least one embodiment, docking features may snap and lock into place when the lid is removed. The flat lid 22 may comprise of different materials including, but not limited to, rubber, plastic, metal, glass, stone, or a combination thereof.

Figure 2:
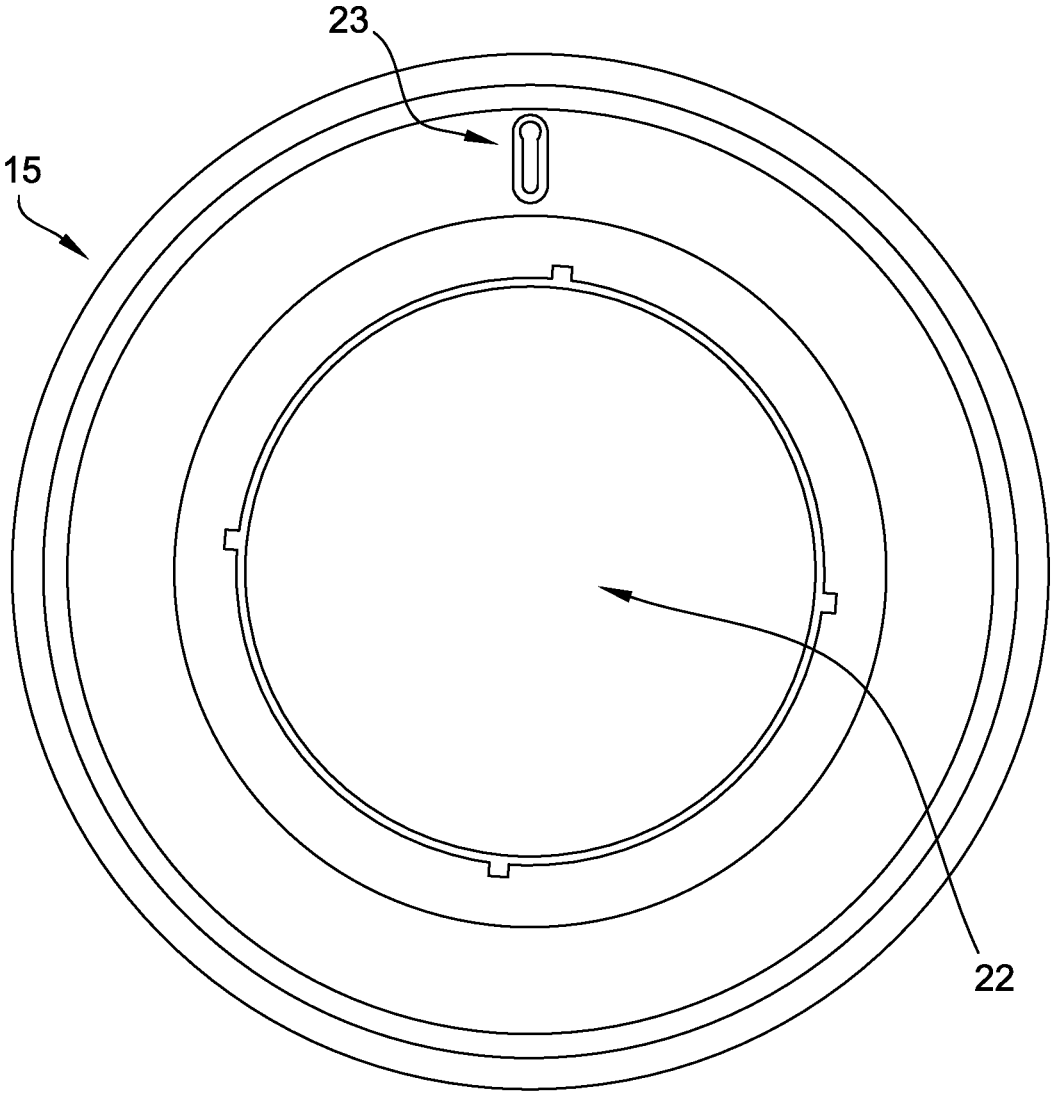
FIG. 2 illustrates the top of the cremation vessel and display with a lid in accordance with at least one embodiment.
Figure 3:
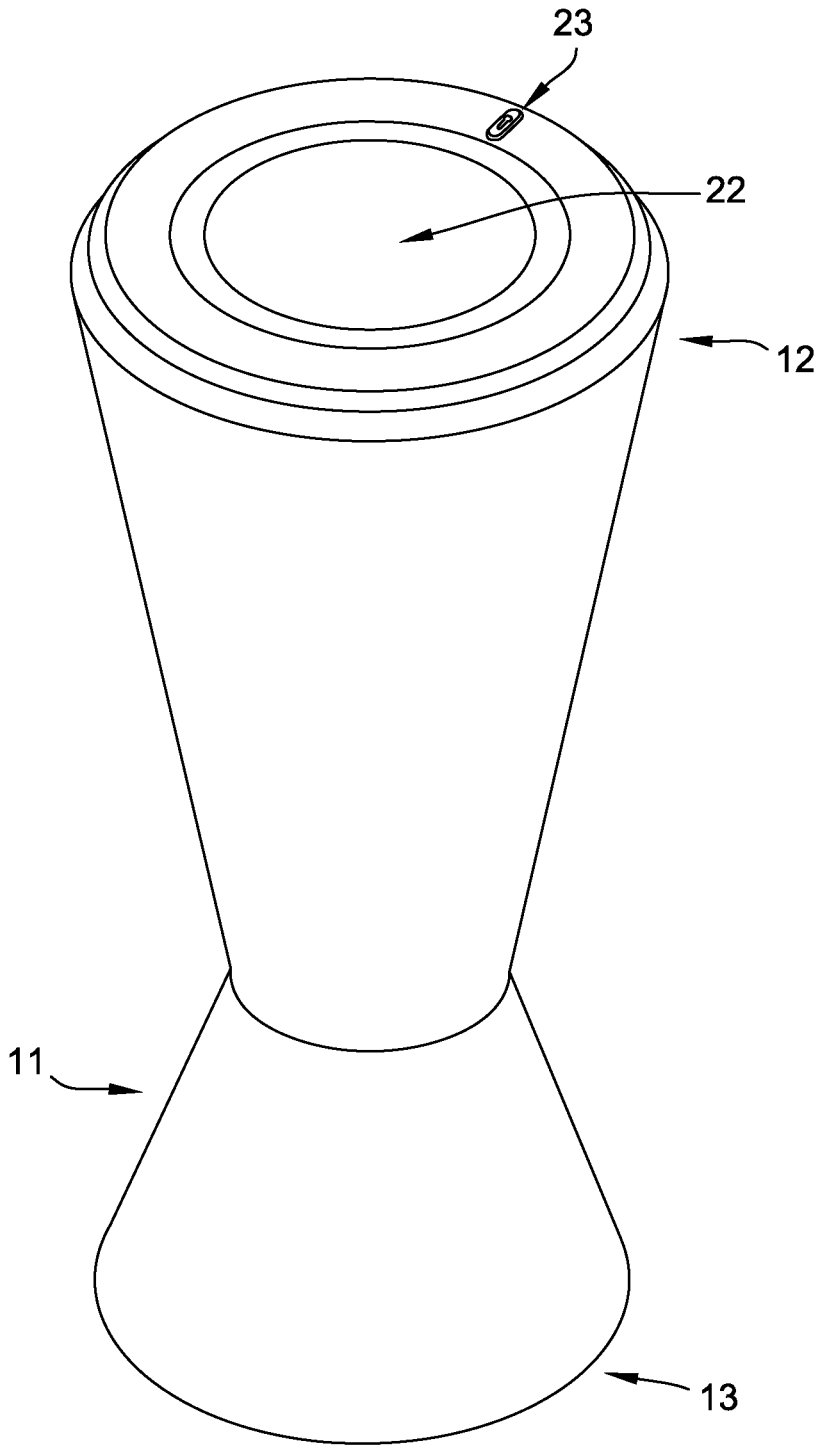
FIG. 3 illustrates a perspective view of the cremation vessel and display with the lid.
Figure 4:
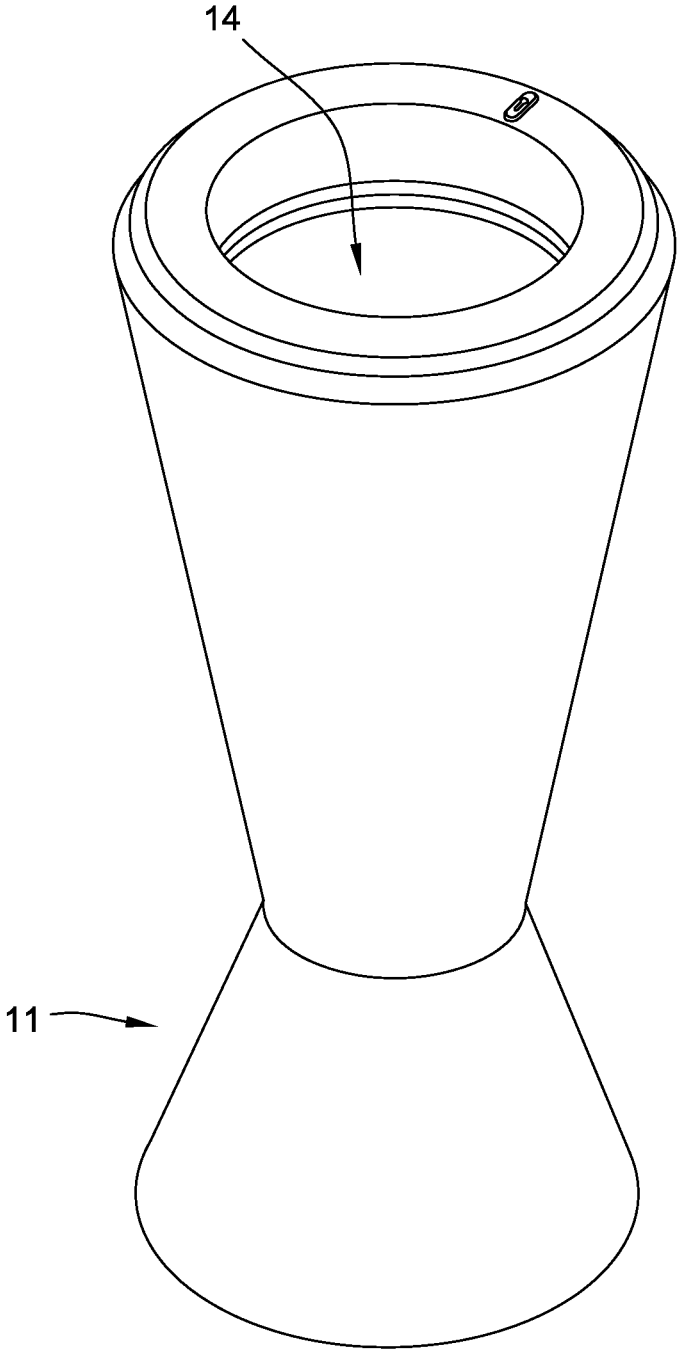
FIG. 4 illustrates a perspective view of the cremation vessel and display.
Figure 5:
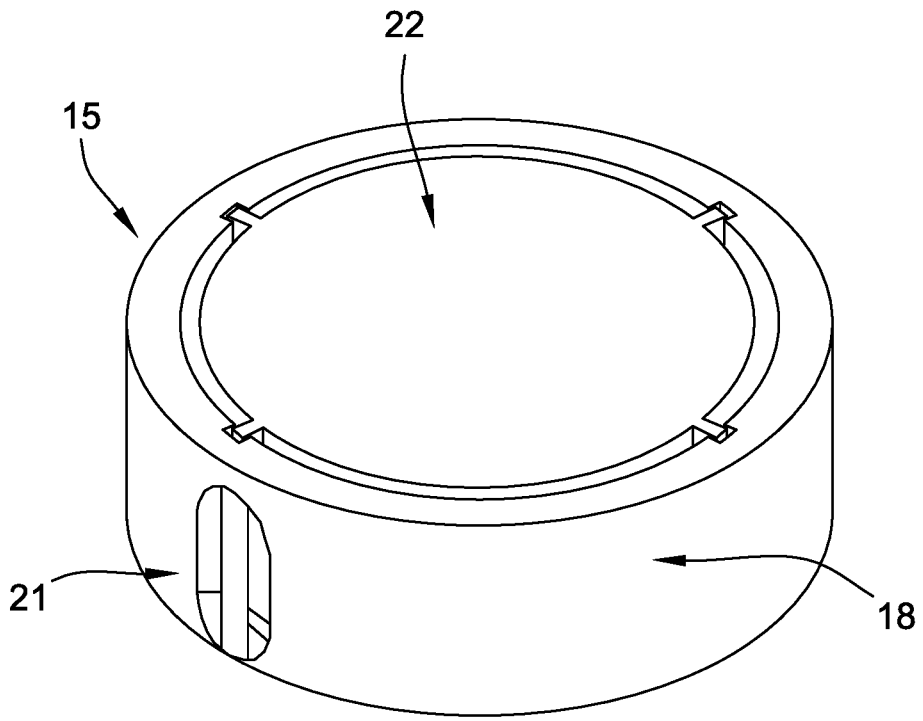
FIG. 5 illustrates a perspective view of the lid.
Figure 6:
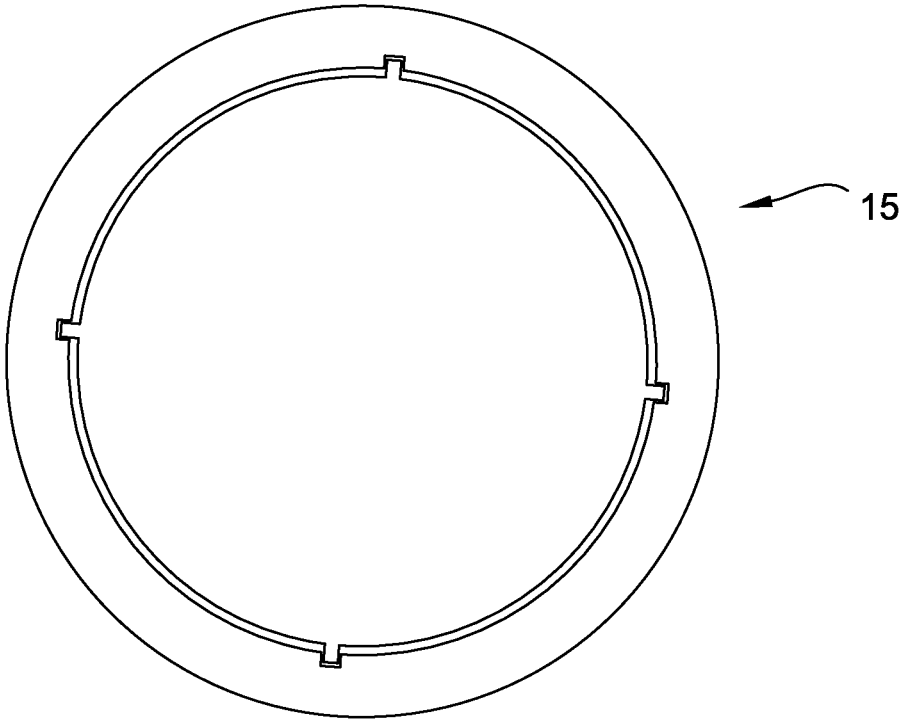
FIG. 6 illustrates the top of the cremation vessel and display.
Figure 7:
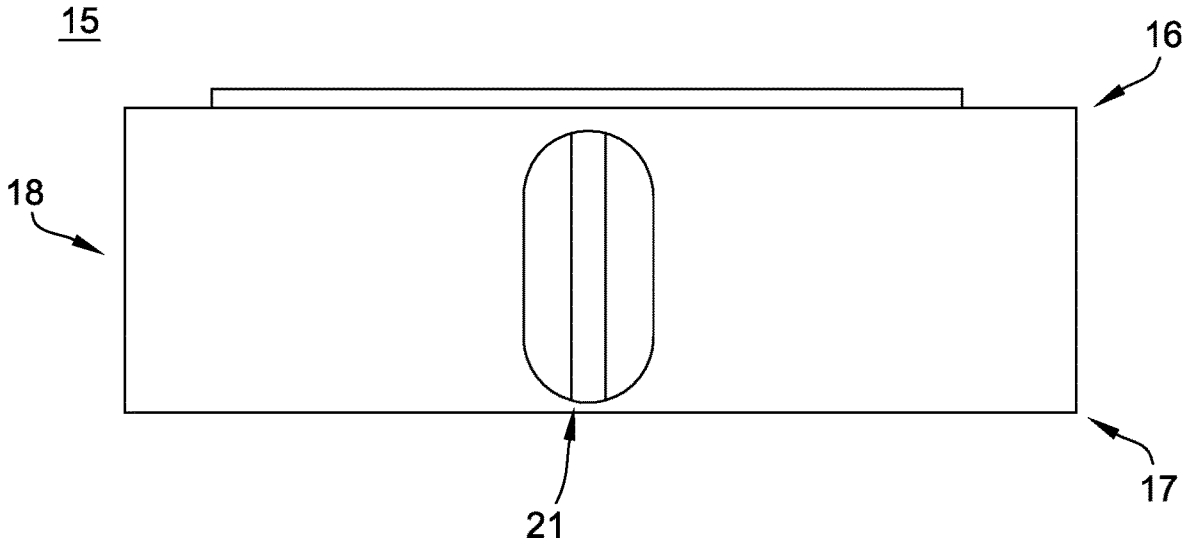
FIG. 7 illustrates the right side of the cremation vessel and display's lid.

As shown in FIG. 2, a lock and key mechanism may be accessed through a key hole 23 on an upper surface of the cap 15. Alternatively, the key hole may be positioned on different surfaces of the cap, such as the side surface or underside. Alternatively, the key and lock mechanism may be a digital lock accessible via a keypad or other type of electronic locking system.

In some embodiment, the cremation vessel includes a ceiling portion, an ornamental feature, and secure locking mechanism to secure the entire structure with a key. The ceiling portion positioned above the base portion and configured with a cavity to store optional functional, decorative, or mechanical features, including but not limited to, ornaments, such as glass or crystal art, projectors to provide interior illumination, static and dynamic images or holographic displays, geolocation, and a locking mechanism for securing ornamental features.

Figure 12:
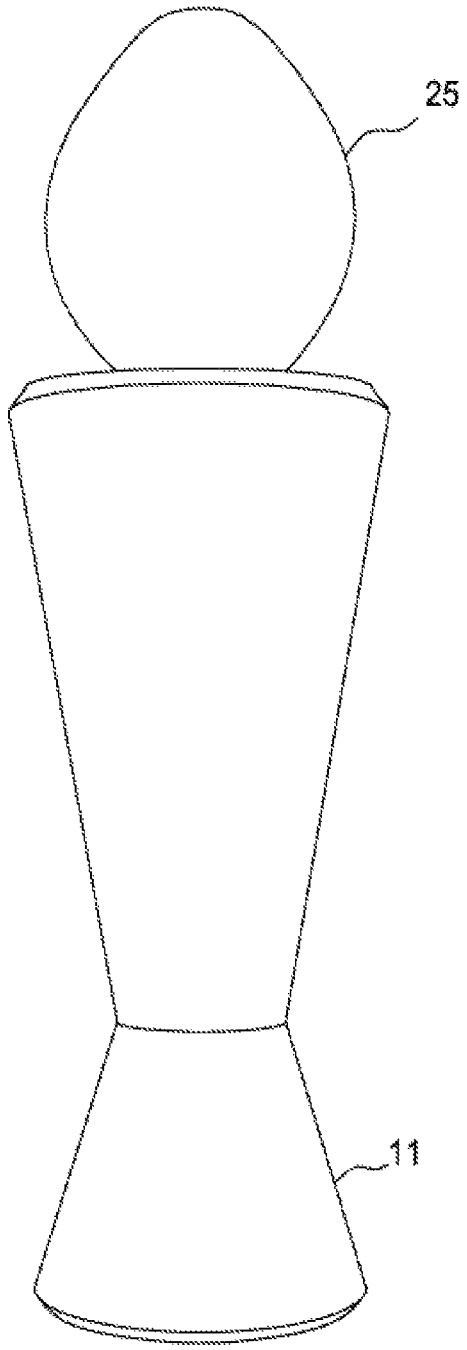
FIG. 12 illustrates another exemplary embodiment of the disclosed cremation vessel and display.

FIG. 12 depicts an exemplary cremation vessel and display according the present disclosure. Accordingly, the vessel and display generally comprises interconnected elements in the form of the base portion 11 and vessel 12 for the placement of ashes and a display feature 25. The interconnected elements may be secured with a locking mechanism described herein and above. Vessel 12 may include a cavity to store functional, decorative, or mechanical features. The cavity, in one example, may house a computing device used to control the display of content by display feature 25, such as illumination, geolocation, and/or holographic elements. The computing device is described further below with respect to FIG. 15.

Figure 14:
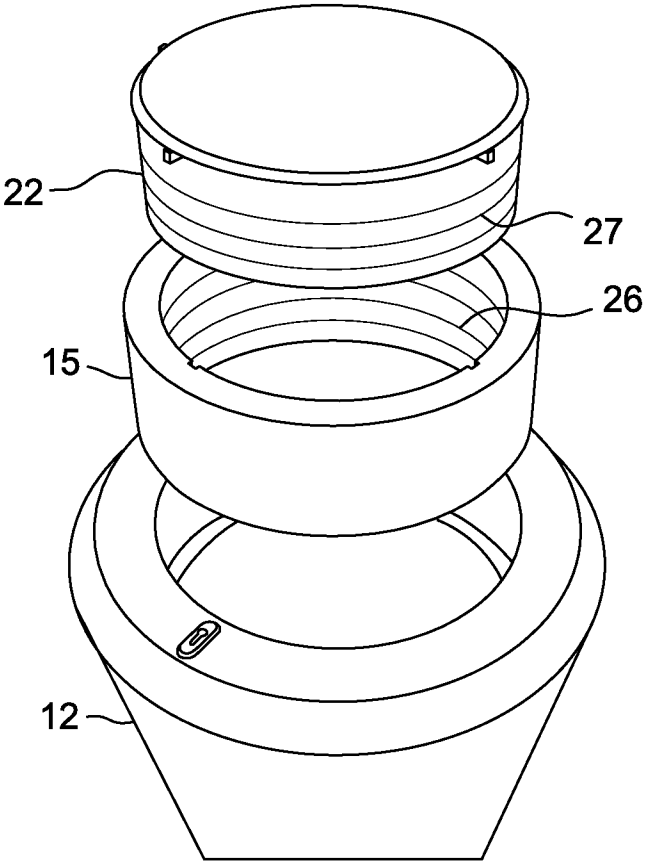
FIG. 14 illustrates an exploded view of the twist lock mechanism components of the cremation vessel and display in accordance with at least one embodiment.
Figure 13:
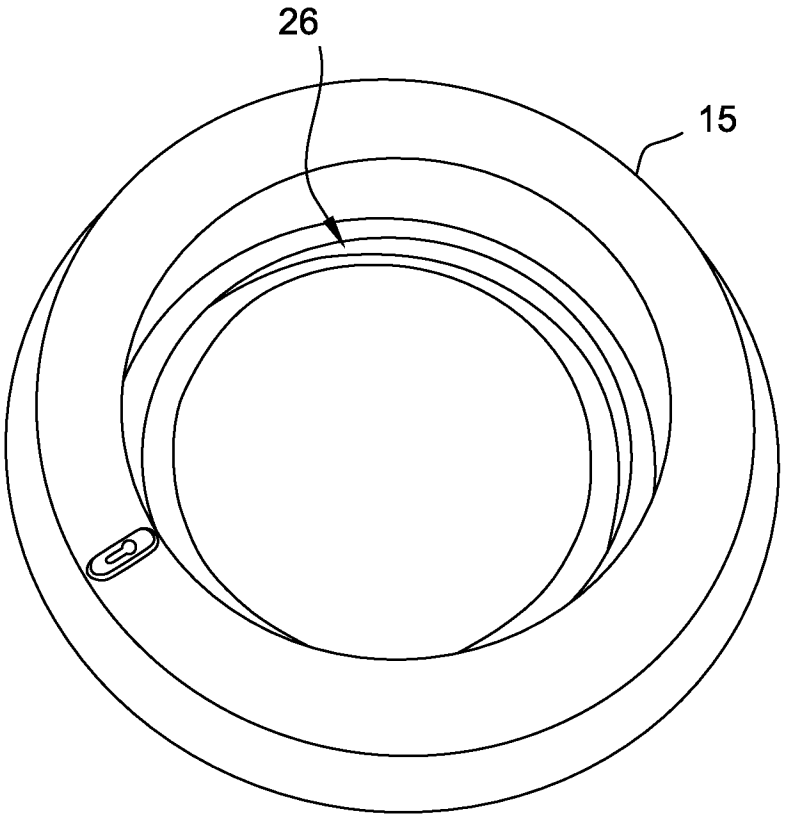
FIG. 13 illustrates an exemplary twist lock mechanism of the cremation vessel and display in accordance with at least one embodiment.

FIGS. 13 and 14 depict an exemplary cap 15 described above for securing the elements of a cremation vessel and display, such as cremation vessel and display of FIG. 1. As shown in FIG. 13, the interior of cap 15 may include one or more threads 26. FIG. 14 depicts an exploded view of the vessel 11, cap 15, and removable cover 22 to include one or more threads 27 to engage one or more threads 26. In one embodiment, cover 22 may be inserted into 15 and twisted, thereby locking the cover into place.

Figure 15:
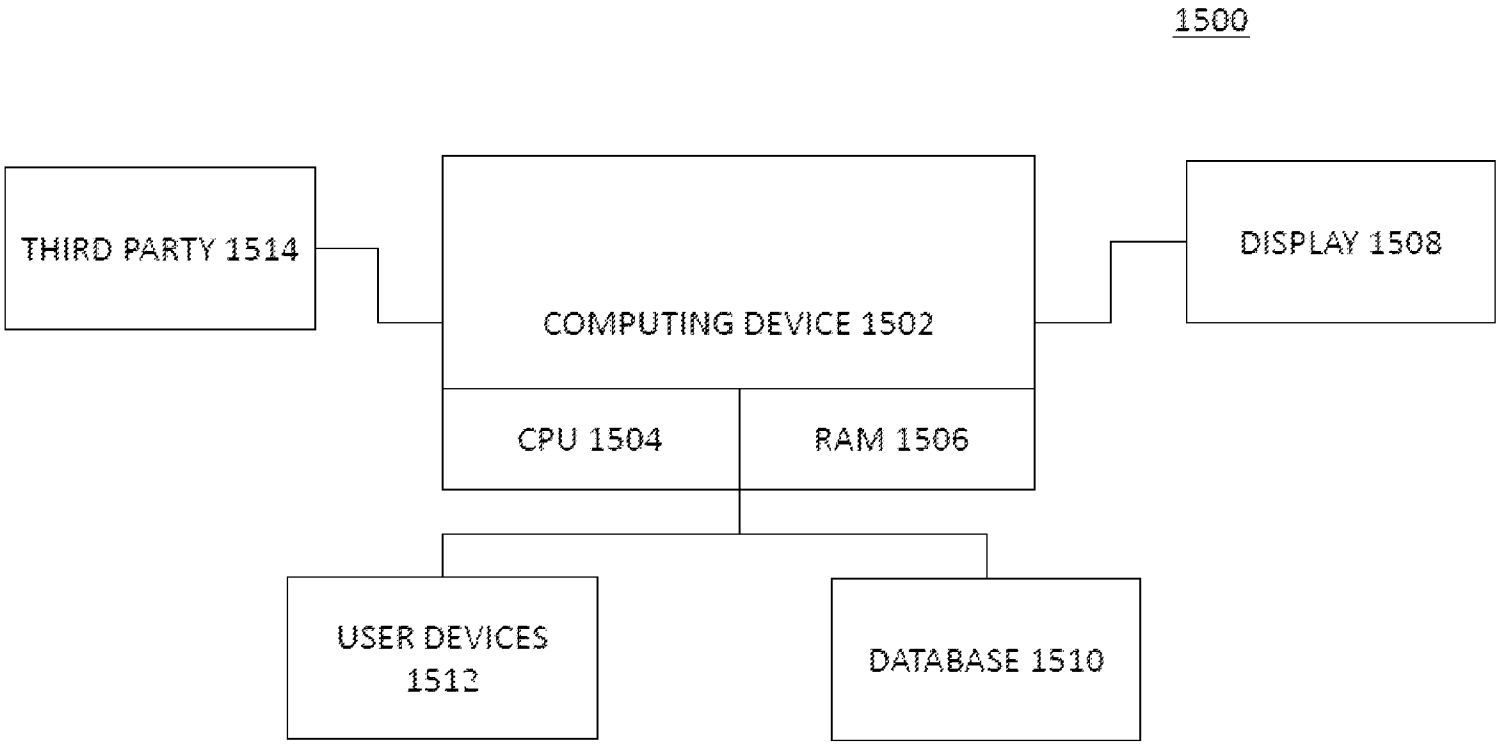
FIG. 15 illustrates an exemplary computing system 1500 in accordance with at least one embodiment.

FIG. 15 depicts a simplified block diagram of an exemplary computing system 1500. In the exemplary embodiment, system 1500 may be used for the displaying of one or more audiovisual or illumination elements by the cremation vessel, such as the cremation vessel shown and described in FIG. 1. System 1500 may include a computing device 1502 having at least one processor 1504 in communication with a memory 1506. Computing device 1502 may be used for the display of one or more audiovisual elements on a display device 1508. The computing device may be in communication with one or more databases (or other memory devices) 1510, user computing devices 1512, and/or third-party servers 1514.

In the exemplary embodiment, user computing devices 1512 may be computers that include a web browser or a software application, which enables user computing devices 1512 to access remote computer devices, such as third party 1514. In one example, a user computing device 1512 may access and retrieve content to be displayed by the cremation vessel from a third party server 1514. The retrieved content may be stored on a memory, such as memory 1506, or stored on a database, such as database 1510, for subsequent retrieval.

User computing devices 1512 may be communicatively coupled to computing device 1502 through many interfaces including, but not limited to, at least one of the Internet, a network, such as the Internet, a local area network (LAN), a wide area network (WAN), or an integrated services digital network (ISDN), a dial-up connection, a digital subscriber line (DSL), a cellular phone connection, and a cable modem. User computing devices 1512 may be any device capable of accessing the Internet including, but not limited to, a desktop computer, a laptop computer, a personal digital assistant (PDA), a cellular phone, a smartphone, a tablet, a phablet, wearable electronics, smart watch, or other web-based connectable equipment or mobile devices. In some embodiments, user computing devices 1512 may transmit data to computing device 1502 (e.g., user data, media content, computer instructions, etc.).

In the exemplary embodiment, the display 1508 may include a projector to provide interior illumination, static and dynamic images, or holographic displays. In some embodiments, illumination may be provided by one or more LED elements powered by a battery (e.g., rechargeable or replaceable). Display 1508 may include a media output component for the displaying of media content. The media output component may include an output adapter such as a video adapter and/or an audio adapter. The output adapter may be coupled to a processor, such as CPU 1504, and a memory device, such as RAM 1506 and adapted to operatively couple to an output device such as a display device (e.g., a cathode ray tube (CRT), liquid crystal display (LCD), light emitting diode (LED) display, or "electronic ink" display) or an audio output device (e.g., a speaker or headphones).

In the exemplary embodiment, the user devices 1512 may include input devices, such as a keyboard, a pointing device, a mouse, a stylus, a touch sensitive panel (e.g., a touch pad or a touch screen), a gyroscope, an accelerometer, a position detector, a biometric input device, and/or an audio input device. A single component such as a touch screen may function as both an output device of media output component and input device.

User computing devices 1512 may also include a communication interface communicatively coupled via a network to computing device 1502. Communication interface may include, for example, a wired or wireless network adapter and/or a wireless data transceiver for use with a mobile telecommunications network.

Stored in memory area 1506 are, for example, computer readable instructions for providing a user interface to user devices 1512 via media output component and, optionally, receiving and processing input from input devices. A user interface may include, among other possibilities, a web browser and/or a client application. Web browsers enable users to configure, customize, display, and interact with media and other information typically embedded on a web page or a website.

Additional Considerations

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

Those of ordinary skill in the art will recognize that many modifications and variations of the present invention may be implemented without departing from the spirit or scope of the invention. Thus, it is intended that the present invention cover the modification and variations of this invention provided they come within the scope of the appended claims and their equivalents.

Those of skill in the art will appreciate that the herein described apparatuses and methods are susceptible to various modifications and alternative constructions. There is no intention to limit the scope of the invention to the specific constructions described herein. Rather, the herein described apparatuses and methods are intended to cover all modifications, alternative constructions, and equivalents falling within the scope and spirit of the disclosure, any appended claims and any equivalents thereto.

In the foregoing detailed description, it may be that various features are grouped together in individual embodiments for the purpose of brevity in the disclosure. This method of disclosure is not to be interpreted as reflecting an intention that any subsequently claimed embodiments require more features than are expressly recited.

Further, the descriptions of the disclosure are provided to enable any person skilled in the art to make or use the disclosed embodiments. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but rather is to be accorded the widest scope consistent with the principles and novel features disclosed herein.

The invention claimed is:

1. A cremation vessel and display, comprising:

a repository for securely housing cremation remains, the repository including at least one wall and a base;

a cap positioned on top of the repository;

one or more microelectronic components contained by the cap; and an ornamental element attached to the cap;

wherein the ornamental element attaches to the cap after removal of a lid from the cap; and wherein the ornamental element is connected to an aperture of the cap via a plug and lock mechanism, the plug and lock mechanism comprising one or more "L" shaped clasps positioned around the perimeter of an interior vertical skirt of the cap.

2. The cremation vessel and display of claim 1, wherein the one or more microelectronic components include one or more of audio, video, illumination, and holographic elements.

3. The cremation vessel and display of claim 1, wherein the one or more microelectronic components include at least one port.

4. The cremation vessel and display of claim 3, wherein the at least one port is at least one of: USB, MicroUSB, or USB-C.

5. An urn comprising:

a base portion for permanently storing cremains;

a ceiling portion positioned on top of the base portion, the ceiling portion having a central aperture;

an ornamental portion installed within the central aperture, the ornamental portion comprising functional, decorative, or mechanical features; and a locking mechanism configured to secure the base portion, ceiling portion, and the ornamental portion using a key.

6. The urn of claim 5, wherein the locking mechanism includes a twist lock mechanism.

7. The urn of claim 5, wherein the ornamental portion is removable.

8. The urn of claim 7, wherein the ceiling portion includes one or more threaded portions for replacing the ornamental portion with a disposable lid.

9. The urn of claim 8, wherein the disposable lid snaps into place on the ceiling portion to create a seal.

10. The urn of claim 5, further comprising:

one or more microelectronic components installed within at least part of a cavity of the ceiling portion, the one or more microelectronic components including a memory and processor configured to:

connect wirelessly to a remote server;

receive instructions for illuminating the ornamental portion; and executing the instructions to illuminate the ornamental portion.

11. The urn of claim 10, wherein the illumination includes one or more of interior illumination, static images, dynamic images, and holographic displays.

12. A cremation urn, comprising:

a housing comprising a compartment configured to receive cremains;

a cap attached to the upper portion of the housing;

an ornamental feature securely connected to the cap via a twist-lock mechanism;

a computing device encapsulated by the cap comprising a memory and a processor, the computing device configured to:

receive media content, the media content comprising one or more static images, dynamic images or holographic displays; and display, via the ornamental feature, the received media content.

* * * * *